US005160281A

United States Patent [19]

Culver et al.

[11] Patent Number: 5,160,281

[45] Date of Patent: Nov. 3, 1992

[54] AUTOMOTIVE HEADLAMP SOCKET

[75] Inventors: John F. Culver, Russell; Douglas G. Seymour, Warren; James C. Humphrey, Russell, all of Pa.

[73] Assignee: GTE Products Corporation, Danvers, Mass.

[21] Appl. No.: 591,194

[22] Filed: Oct. 1, 1990

[51] Int. Cl.[5] ..... H01R 13/40

[52] U.S. Cl. ..... 439/692; 439/733

[58] Field of Search ..... 439/692, 733

[56] References Cited

U.S. PATENT DOCUMENTS

| | | | |
|---|---|---|---|
| 2,012,696 | 8/1935 | Sorensen et al. | 439/692 |
| 3,362,006 | 1/1968 | Fuller | 439/692 |
| 3,621,444 | 11/1971 | Stein | 439/733 |
| 4,507,712 | 3/1985 | Dolan et al. | 362/61 |
| 4,528,619 | 7/1985 | Dolan et al. | 439/375 |
| 4,569,005 | 2/1986 | Bergin et al. | 362/267 |
| 4,569,006 | 2/1986 | Bergin et al. | 362/267 |
| 4,623,958 | 11/1986 | Van der Linde et al. | 362/267 |
| 4,641,056 | 2/1987 | Sanders et al. | 362/296 |
| 4,795,388 | 1/1989 | Coliandris et al. | 445/27 |

*Primary Examiner*—Gary F. Paumen

*Attorney, Agent, or Firm*—William H. McNeill

[57] ABSTRACT

An automotive headlamp socket includes an interior floor having a wall projecting therefrom. The wall contains a plurality of T-shaped slots which frictionally accept electrical contacts.

3 Claims, 4 Drawing Sheets

AUTOMOTIVE HEADLAMP SOCKET

CROSS-REFERENCE TO RELATED APPLICATION

Attorney Docket No. 88-2-214 contains related subject matter and is filed concurrently herewith.

TECHNICAL FIELD

This invention relates to lamp sockets and more particularly to such sockets wherein at least some of the electrical contacts are frictionally retained in position.

BACKGROUND ART

Automobile headlamp sockets, for use with replaceable bulbs, are known. Such sockets usually employ a plurality of electrical contacts which are held in place by deformed metal eyelets, such as shown in U.S. Pat. Nos. 4,623,958; 4,795,388; 4,569,006; 4,569,005; 4,528,619; 4,507,712; or by a twisted contact embedded in a socket floor, such as shown in U.S. Pat. No. 4,641,056.

Such contacts are difficult to maintain in proper orientation, and assembly of the contacts with a socket is difficult and expensive.

SUMMARY OF THE INVENTION

It is, therefore, an object of the invention to obviate the disadvantages of the prior art.

It is another object of the invention to enhance electrical contacts for automotive headlamp sockets.

It is another object of the invention to provide a socket to receive and frictionally hold a contact.

These objects are accomplished, in one aspect of the invention, by the provision of a lamp socket which has an elongated body with a longitudinal axis and a first, hollow, lamp receiving end and a second, hollow, plug receiving end arrayed along the axis. A transverse floor extends across the body and separates the first end from the second end. A wall projects from the floor into the second end and contains a plurality of electrical contact receiving means therein for frictionally engaging the contacts and maintaining them in position.

These sockets eliminate the eyelet holding means of the prior art and provide cheaper and easier assembly.

BEST MODE FOR CARRYING OUT THE INVENTION

For a better understanding of the present invention, together with other and further objects, advantages and capabilities thereof, reference is made to the following disclosure and appended claims taken in conjunction with the above-described drawings.

Figure 1:
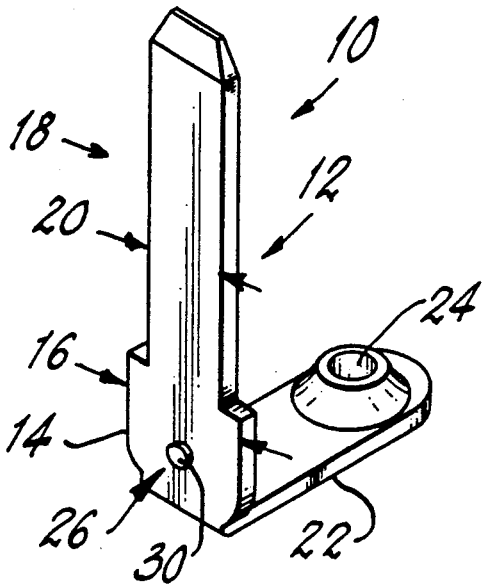
FIG. 1 is a perspective view of an embodiment of an electrical contact for use with the invention.
Figure 2:
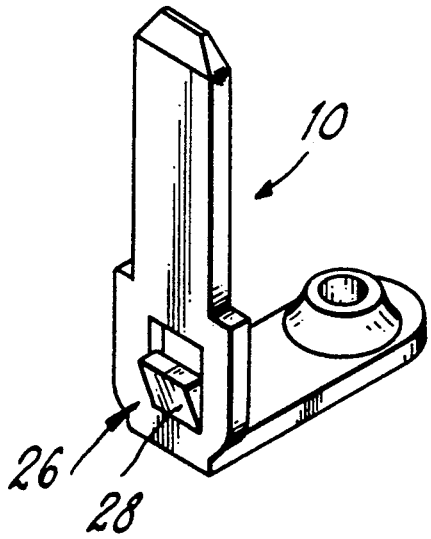
FIG. 2 is a perspective view of an alternate electrical contact.

Referring now to the drawings with greater particularity, there is shown in FIG. 1 an electrical contact 10 having an elongated portion 12 which includes a body 14. The body 14 has a given width, indicated as 16, and has a tang 18 extending therefrom. The tang 18 has a width 20 which is less than the given width 16. A foot 22 also has width less than given width 16, and extends from body 14 at a right angle. An aperture 24, which is preferably conical, is provided in the distal end 25 of foot 22. Contact retention means 26 are associated with body 14. In the embodiment of FIG. 1, the contact retention means 26 is in the form of a protuberance or dimple 30. In FIG. 2, the contact retention means comprises a lanced-out tongue 28.

The contact is preferably made from CDA-230 brass and may be tin-plated.

Figure 3:
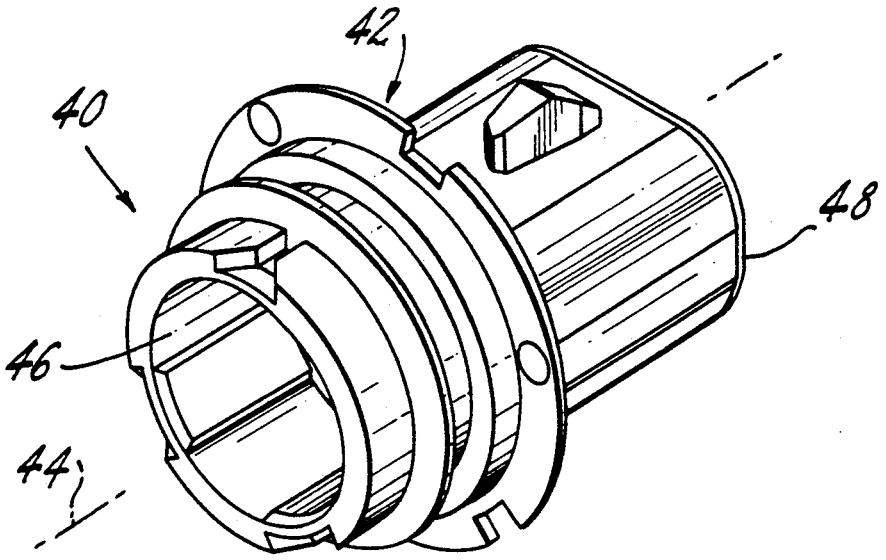
FIG. 3 is perspective view of a socket.
Figure 4:
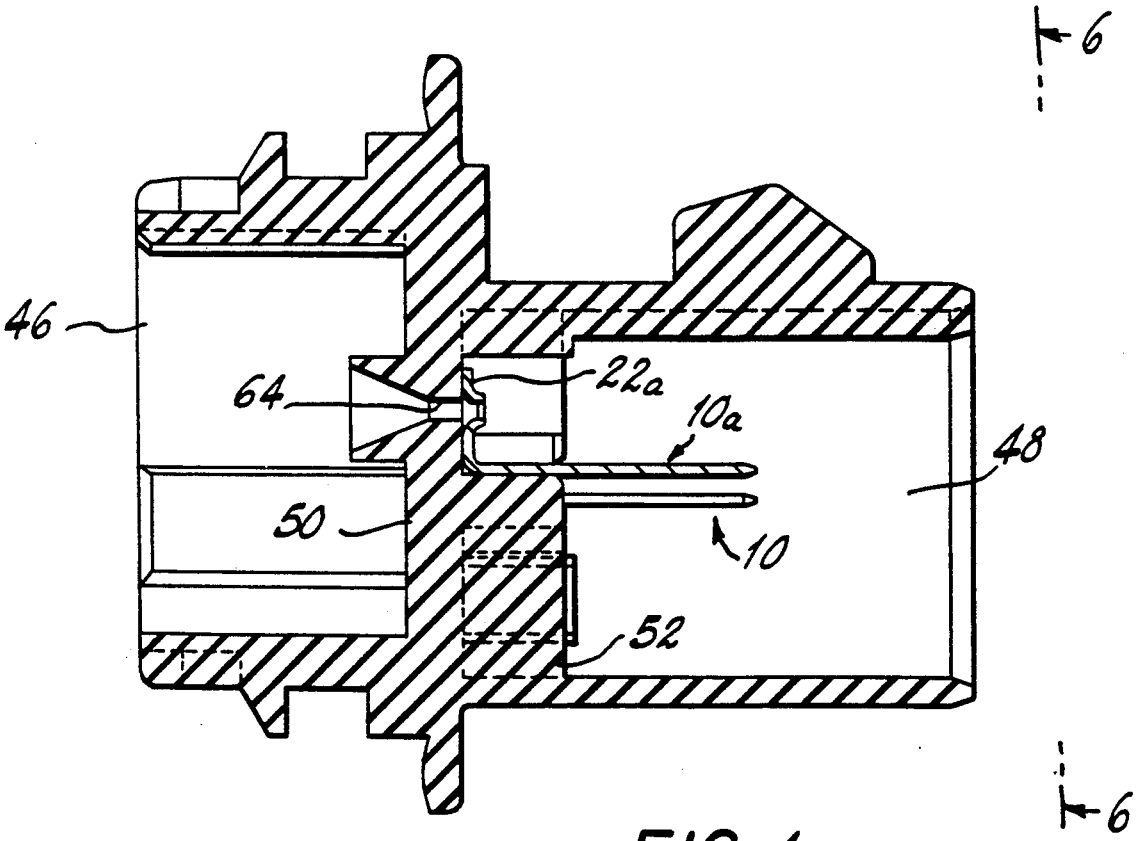
FIG. 4 is a longitudinal sectional view of the socket of FIG. 3.

FIG. 3 illustrates a lamp socket 40 having an elongated body 42 with a longitudinal axis 44. A first, hollow, lamp receiving end 46 and a second, hollow, plug receiving end 48 are arrayed along the longitudinal axis 44 and are separated by a transverse floor 50 (see FIG. 4) which extends across the body 42. A transverse wall 52 projects from the floor 50 into the second end and contains a plurality of electrical contact receiving means 54 therein (see FIG. 5).

Figure 5:
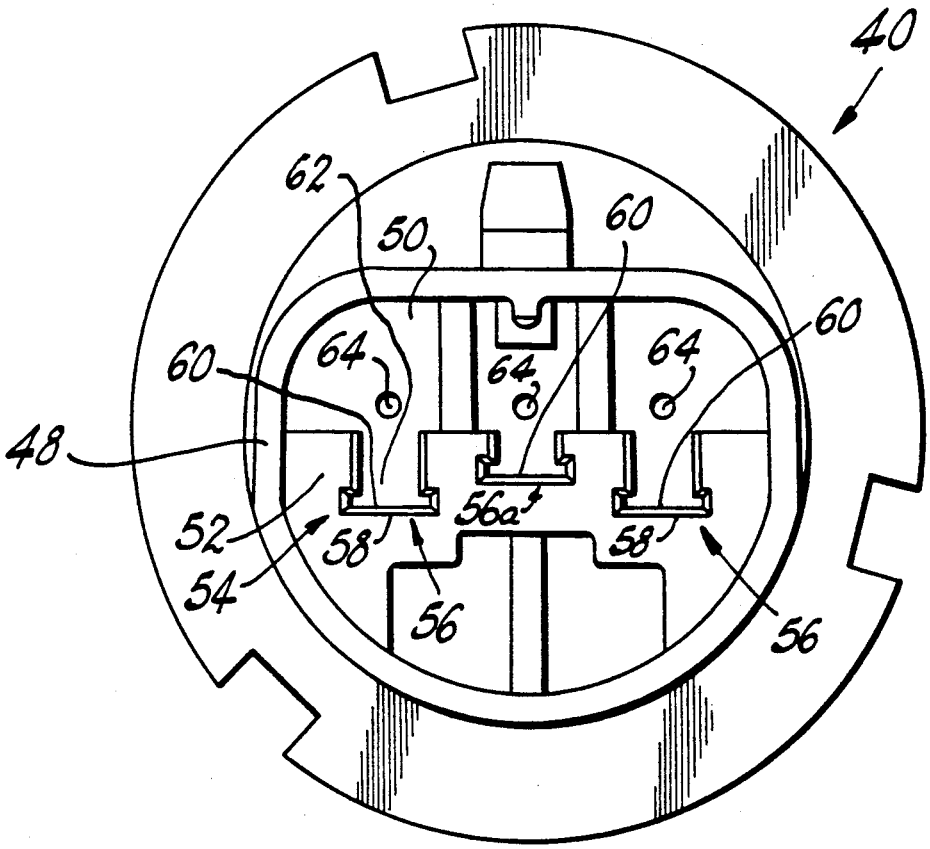
FIG. 5 is an end view of the socket of FIG. 3, with no contacts in position.
Figure 6:
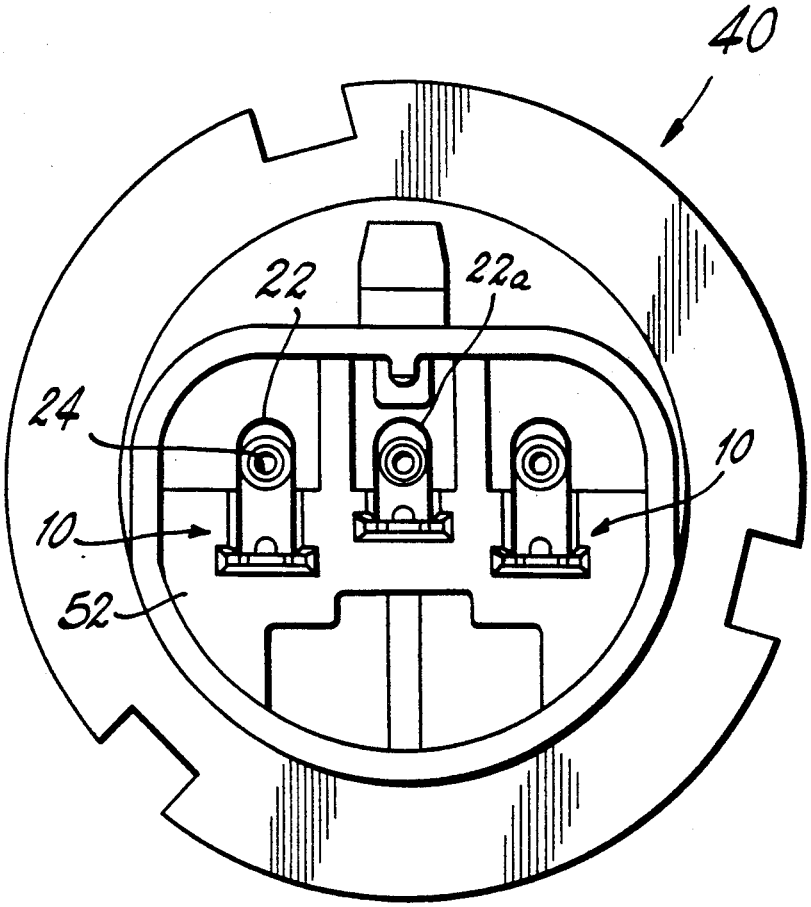
FIG. 6 is a view similar to FIG. 5, taken along the line 6—6 of FIG. 4, with the electrical contacts in position.

As best seen in FIGS. 5 and 6, the receiving means 54 comprise three T-shaped slots 56. The center slot, **56*a***, is offset from the other two.

The tops of the "T," indicated at 58, have a width substantially equal to, but not greater than, the given width 16 of contact 10, whereby a frictional fit is obtained. Additionally, the contact retention means 26 of contacts 10 engage the backs 60 of slots 56 to further retain the contacts 10 in position. To avoid bending the foot 22 during contact insertion the width of the foot is less than the width of the stem 62 of the T-shaped slots 56.

Because of the offset of the center slot **56*a* (see FIGS. 4, 5, and 6) the foot 22*a* of the center contact 10*a*, is shorter than the other two contacts 10**.

The apertures 24, which are formed in the distal end of the feet 22, **22*a*, align with apertures 64 formed in floor 50**. These apertures accept the leads from the headlamp capsule, as shown in any of the patents cited herein; e.g. U.S. Pat. No. 4,623,958.

To aid in inserting the contacts, the leading edges of the slots 56 can be chamfered, as shown.

The material for the socket body is preferably Ultem 2310-5313G, which is available from the General Electric Company.

Accordingly, this lamp socket is easier to manufacture and less expensive to assemble than those of the prior art.

While there have been shown what are at present considered to be the preferred embodiments of the invention, it will be apparent to those skilled in the art that various changes and modifications can be made herein without departing from the scope of the invention as defined by the appended claims.

We claim:

1. A lamp socket comprising an elongated body with a longitudinal axis and having a first, hollow, lamp receiving end and a second, hollow, plug receiving end; a transverse floor extending across said body and separating said first end from said second end; a transverse wall projecting from said floor into said second end, said wall having a plurality of electrical contact receiving means therein.

2. The lamp socket of claim 1 wherein there are three slots.

3. The lamp socket of claim 2 wherein one of said slots is offset from the other two.

* * * * *